US005314166A

United States Patent [19]

Muir

[11] Patent Number: 5,314,166

[45] Date of Patent: May 24, 1994

[54] SELF-TAILING WINCH WITH FREE-FALL CAPACITY

[75] Inventor: Robert J. Muir, Kingston, Australia

[73] Assignee: Muir Engineering Pty. Limited, Kingston, Australia

[21] Appl. No.: 69,448

[22] Filed: Jun. 1, 1993

Related U.S. Application Data

[63] Continuation of Ser. No. 772,237, Oct. 7, 1991, abandoned.

[51] Int. Cl.[5] ..... B66D 1/30

[52] U.S. Cl. ..... 254/371; 254/372

[58] Field of Search ..... 254/361, 362, 371, 372, 254/382, 378

[56] References Cited

U.S. PATENT DOCUMENTS

| | | | |
|---|---|---|---|
| 1,380,655 | 6/1921 | Larson | 254/382 |
| 3,985,340 | 10/1976 | Guangorena | 254/371 |
| 4,453,701 | 6/1984 | Huggett | 254/371 |
| 4,497,471 | 2/1985 | Longberg et al. | 254/372 |
| 4,632,363 | 12/1986 | Frommherz | 254/371 |
| 4,681,301 | 7/1987 | Rinio | 254/371 |
| 4,815,710 | 3/1989 | Bonassi | 254/371 |

*Primary Examiner*—Joseph J. Hail, III

*Attorney, Agent, or Firm*—Edwin D. Schindler

[57] ABSTRACT

A which winch can permit free-fall is disclosed, which includes a shaft adapted to be driven by a source of power, a first cone connected about the shaft to be driven therewith, and a second cone co-axial with the first cone and movable axially relative thereto. The second cone can be caused to assume one of two axial positions relative to the first cone, the arrangement being such that a rope or chain passing between the two cones can be driven by the winch when the second cone is in one of its two positions and can free-fall when the second cone is in the other of its two positions.

7 Claims, 6 Drawing Sheets

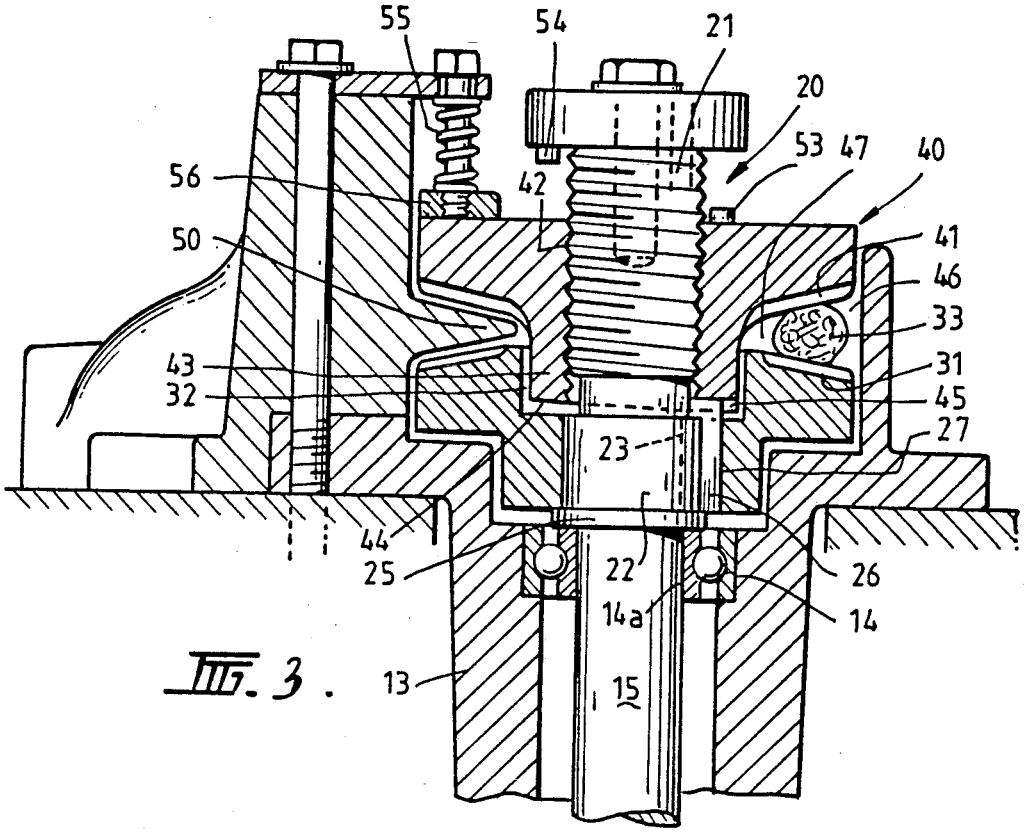
FIG. 3.
FIG. 4.
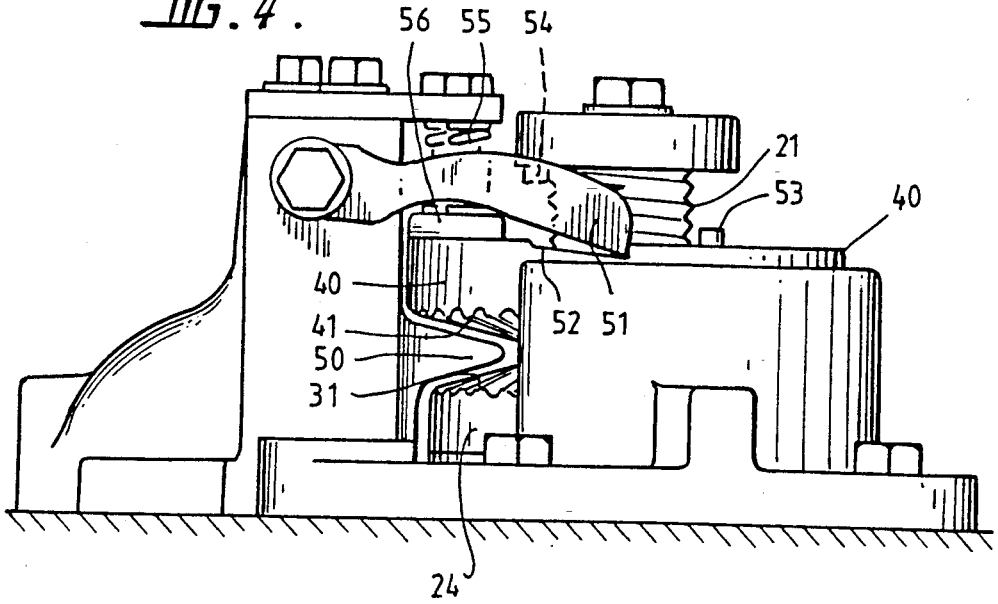

SELF-TAILING WINCH WITH FREE-FALL CAPACITY

This application is a continuation of application Ser. No. 07/772,237, filed Oct. 7,1991, now abandoned.

BACKGROUND OF THE INVENTION

This invention relates to a rope winch and in particular to a winch which can permit ready free falling.

Winches of this type are particularly suitable for use as anchor winches as, when the anchor is to be lowered, the weight of the anchor can permit free falling of the rope or chain through the winch but, when the anchor is to be raised then the winch needs to be operative to raise the rope or chain.

The requirements of a winch of this type are firstly, when the winch is being used then the rope is firmly grasped or the chain is locked so there is little or no slipping, that for rope winches the winch whilst firmly grasping the rope does not damage this by undue compression, and in both cases, when the winch is released there is little obstruction to free falling.

SUMMARY OF THE INVENTION

It is the object of the present invention to provide a winch which has three characteristics.

The winch of the present invention comprises a winch which can permit free-fall comprising a shaft adapted to be driven by a source of power; a first cone connected about the shaft to be driven therewith; a second cone co-axial with the first cone and moveable axially relative thereto; means whereby the second cone can be caused to assume one of two axial positions relative to the first cone, the arrangement being such that a rope or chain passing between the two cones can be driven by the winch when the second cone is in one of its two positions and can free fall when the second cone is in the other of its two positions.

Preferably the second cone is threaded and the portion of the shaft which extends from the first cone is also threaded and means are provided to restrict the movement of the second cone on the threaded portion relative to the first cone.

In order that the invention may be more readily understood we shall describe, in relation to the accompanying drawings, two particular forms of winch made in accordance with the invention.

BRIEF DESCRIPTION OF THE DRAWING FIGURES

In these drawings:

FIG. 3 is a section along line 3—3 of FIG. 2 showing the position where the two cones are adjacent;

FIG. 4 is an elevation along line 4—4 of FIG. 2;

DETAILED DESCRIPTION OF THE DRAWING FIGURES

Figure 1:
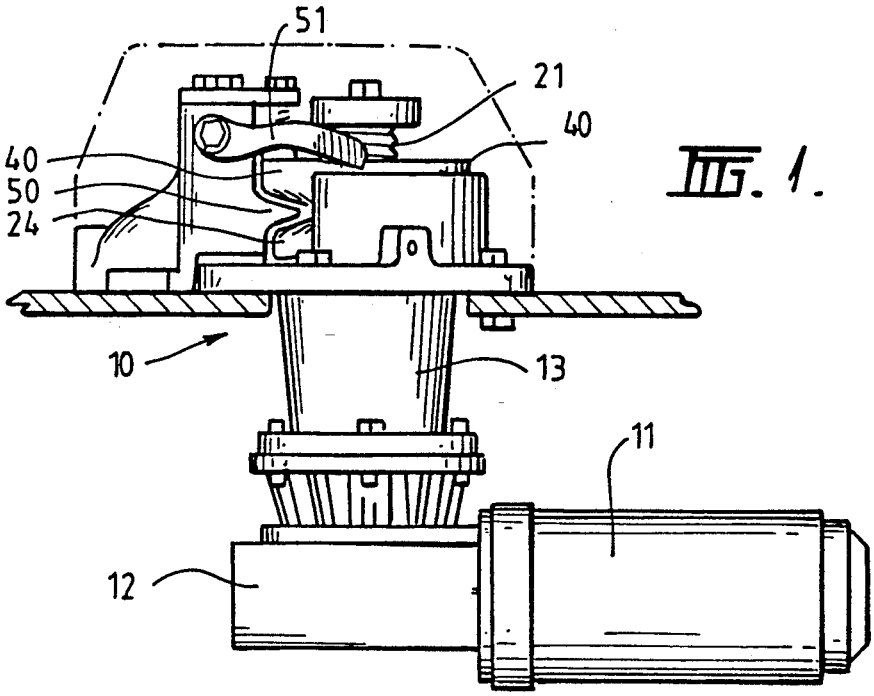
FIG. 1 is a side elevation of a first form of winch made in accordance with the invention showing the deck or other mounting arrangement section.
Figure 5:
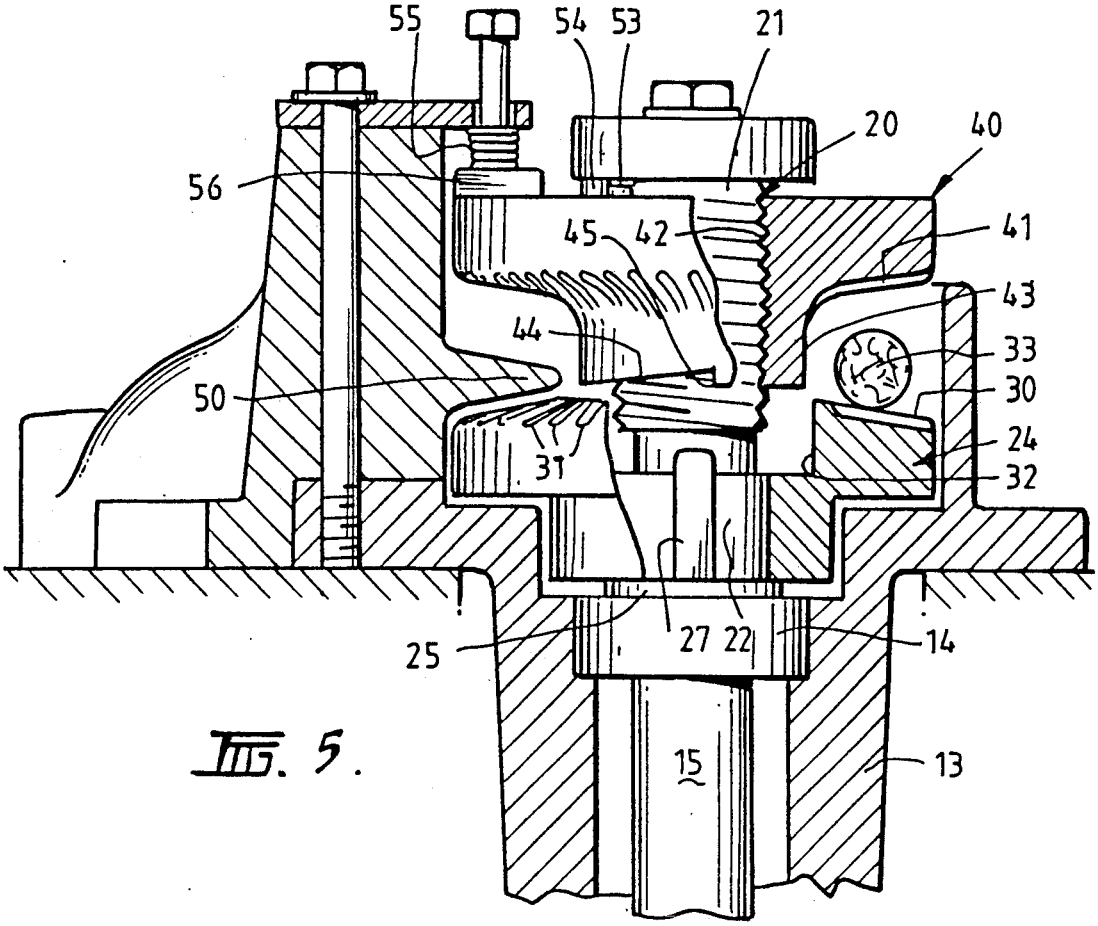
FIG. 5 is a section similar to that of FIG. 3 showing the two cones separated.
Figure 2:
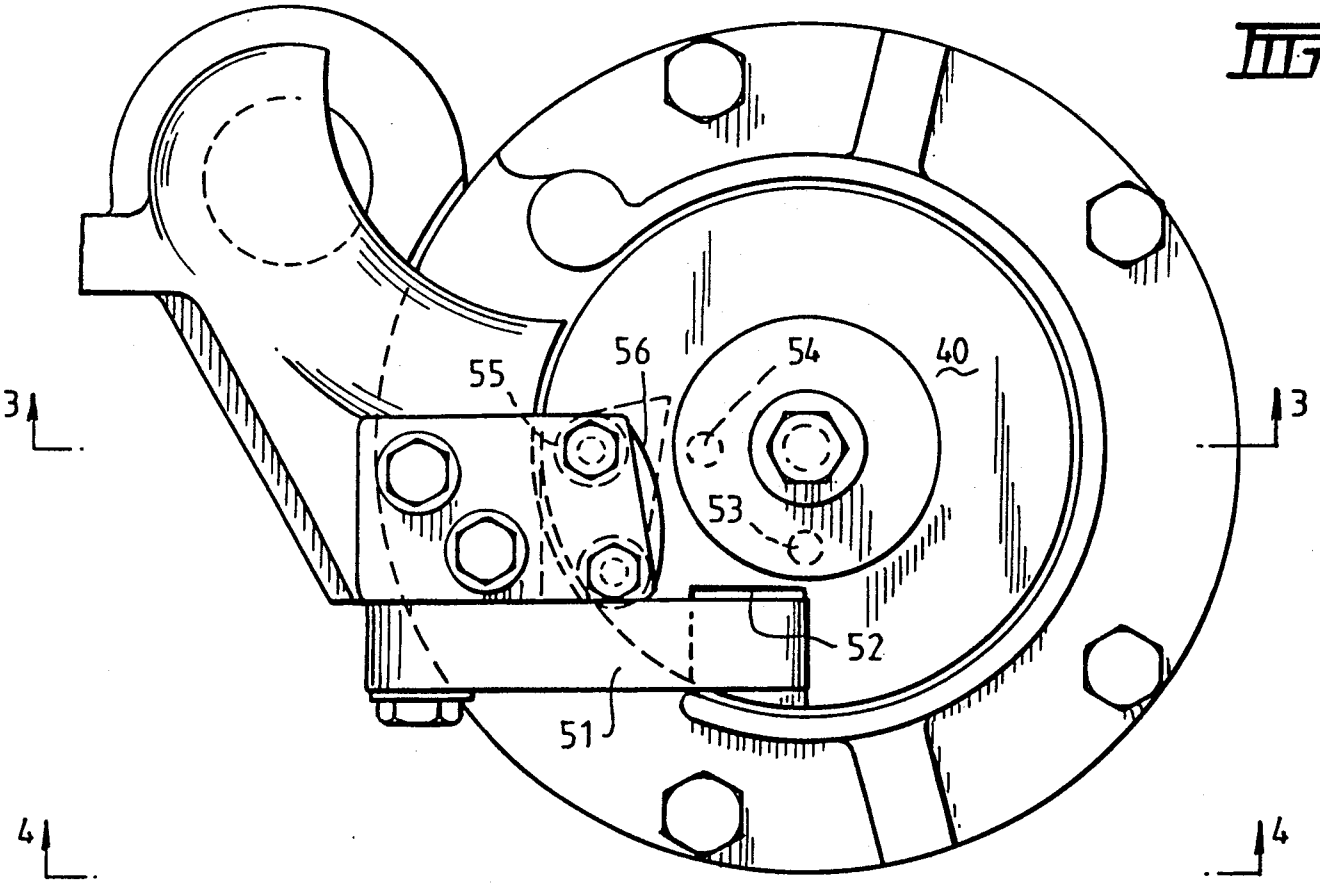
FIG. 2 is a plan view of the winch of FIG. 1 having its cover, shown in chain-dash in FIG. 1 removed.

Referring firstly to FIGS. 1 to 5, the winch 10 may be driven by any form of prime mover but normally by means of an electric or hydraulic motor 11, and if required the motor may be provided with a gear box 12 to provide an output of the order of speed required.

The winch has a housing 13 which is connected to the motor or its gear box and this may be provided with an axial aperture therethrough which aperture may be formed to receive one or more bearings 14 in which the winch main shaft 15 can rotate.

The main shaft is provided with means at its lower end to engage with the motor or gear box.

The upper end 20 of the main shaft is externally threaded 21 as will be further described later.

Below the externally threaded portion there may be a parallel sided portion 22 having an extension 25 therebelow which extension can contain the inner face 14*a* of the bearing 14 and the parallel sided member having a keyway 23 formed therein. A lower cone 24 is adapted to be located on the portion 22 and is restrained against downward movement by the extension 25.

The lower cone 24, which may be made of bronze and can preferably be a bronze casting is adapted to fit over the portion 22 and is provided with a keyway 26 which corresponds to the keyway 23 in the shaft. A key 27 can be located in the keyways 23, 26 whereby the cone can be located on the shaft and rotate relative thereto.

The upward face 30 of the cone is angled outwardly and downwardly and may be provided with cutout slots 31 which extend across the body thereof which provide edges which can provide good frictional engagement with a rope 33 lying thereon.

These slots 31 may be radial but are preferably at an angle to the radius.

An upper cone 40 has a conical face 41 which may be basically complementary to the lower face 30 and has a central threaded aperture 42 which corresponds to the threaded upper portion 21 of the shaft 15 and may be threaded thereover.

The cone 40 may have an extended, generally cylindrical, portion 43 which is adapted to be received within a cutout portion 32 of the lower cone and the face 44 of the cone 40 and the extended portion 43 may be formed to provide a good frictional resistance with a rope.

This lower end 44 of the extended portion may be tapered and end with a shoulder 45 and this may be adapted to engage with the key 27 which locks the lower cone 24 to the shaft 15 but which key 27 extends into the cutout portion 32 of the lower cone.

The threads 21, 42 on the shaft and the upper cone are of a relatively coarse pitch and the arrangement is such that as the upper cone 40 is screwed down onto the thread the shoulder 45 on the relieved portion will contact the key 27 over a substantial portion of its length thus preventing further rotation but which will be free from contact after one revolution in the opposite sense.

This shoulder 45 and the key 27 then act as a stop to limit movement of the upper cone 40 toward the lower cone 24.

The arrangement is such that when this position is achieved the spacing between the two cones at the outer edge 46 thereof is slightly greater than the maximum diameter of rope 33 with which the winch is to be used and is narrower than this at the inner edge 47.

The arrangement is generally such that as upper cone moves on to the lower cone the rope to be moved by the winch is pinched and a good frictional contact is achieved, but it is not crushed.

When the winch is being driven by the motor 11 it will be appreciated that the two cones 24, 40 remain in this locked position and as further rope is fed through the winch it will be fed into the winch at the open portion and will move inwardly until it is gripped.

The winch may be designed for basically straight through operation of the rope and we may provide a peeler 50 which has an extension which enters the spacing between the cones at an angle to cause the rope to be forced outwardly when it reaches the position of the peeler.

The peeler may be associated with an enclosed path and may have an aperture therethrough which can effectively be a chain pipe so that the rope can be delivered to a chain locker.

When the rope is to be permitted to free fall, say when an anchor is to be dropped, it is required to permit the two cones 24, 40 to separate and it will be appreciated that this can be done by holding the upper cone 40 from rotation whilst rotating the shaft 15 in the sense opposite to its normal rotation.

In order to do this we provide a pawl 51 which can selectively contact a detent 52 in the upper surface of the upper cone 40.

The pawl 51 and detent 52 are such that when the drive is reversed the upper cone 40 is held against rotation and the cone moves towards the upper end 20 of the shaft and may be provided with a stop means 53 which acts against, say, an extension 54 on the top of the shaft when it has reached a position sufficiently high to permit the rope 33 to effect unrestricted free falling.

The movement may also act to compress a spring 55 on a brake pad 56 which acts against the top of the upper cone 40 so that there is a downward pressure on the cone.

When the winch is to be driven in its normal sense, to cause a rope to move therethrough, the pressure from the spring 55 and the resistance provided by the brake pad 56 cause the cone to be held against rotation and thus move downwardly until the cones are locked and the drive position is automatically achieved.

Figure 6:
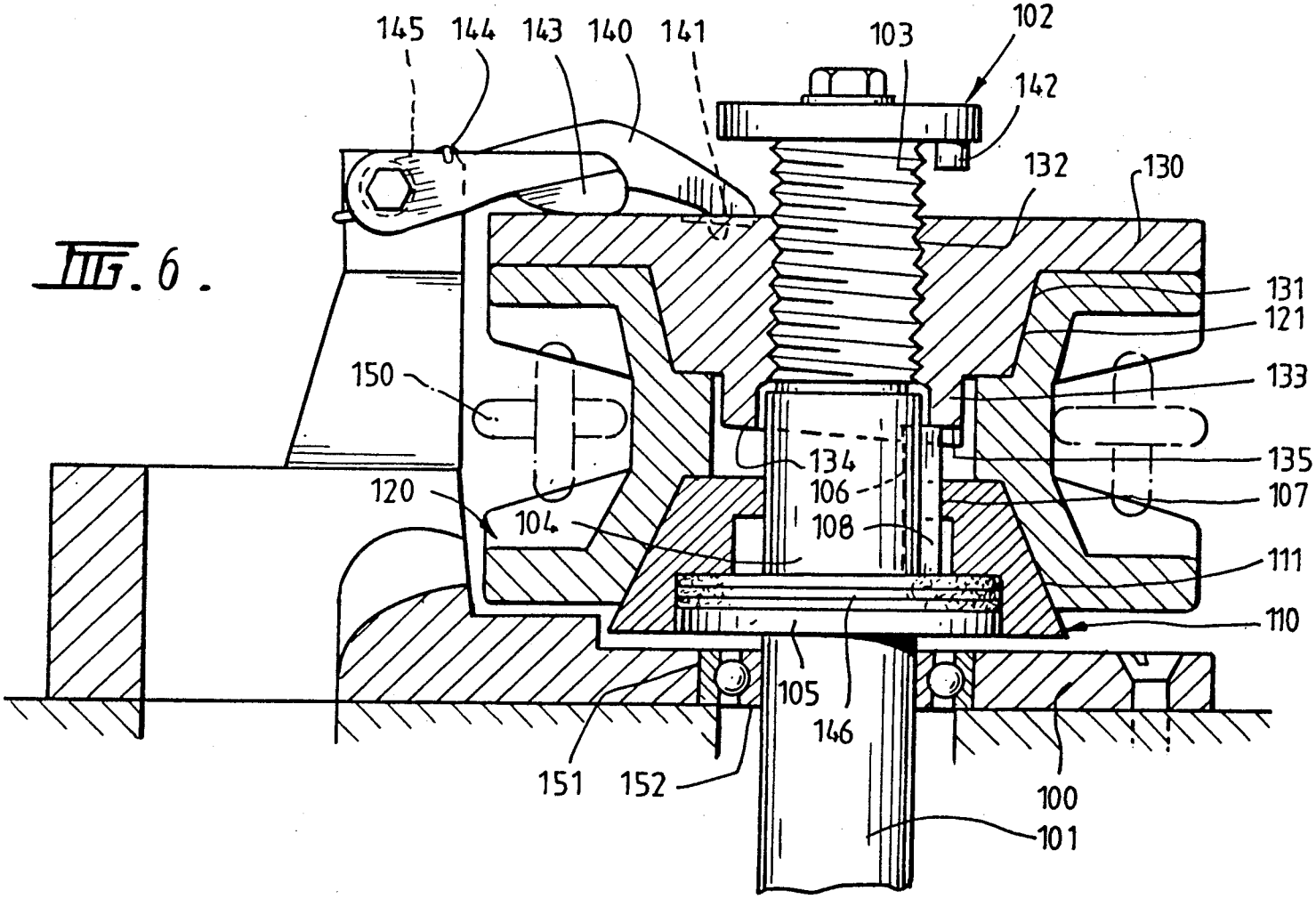
FIG. 6 is a first section of a second form of winch which generally works in the same manner as the first form and having the two cones in their closet position.
Figure 7:
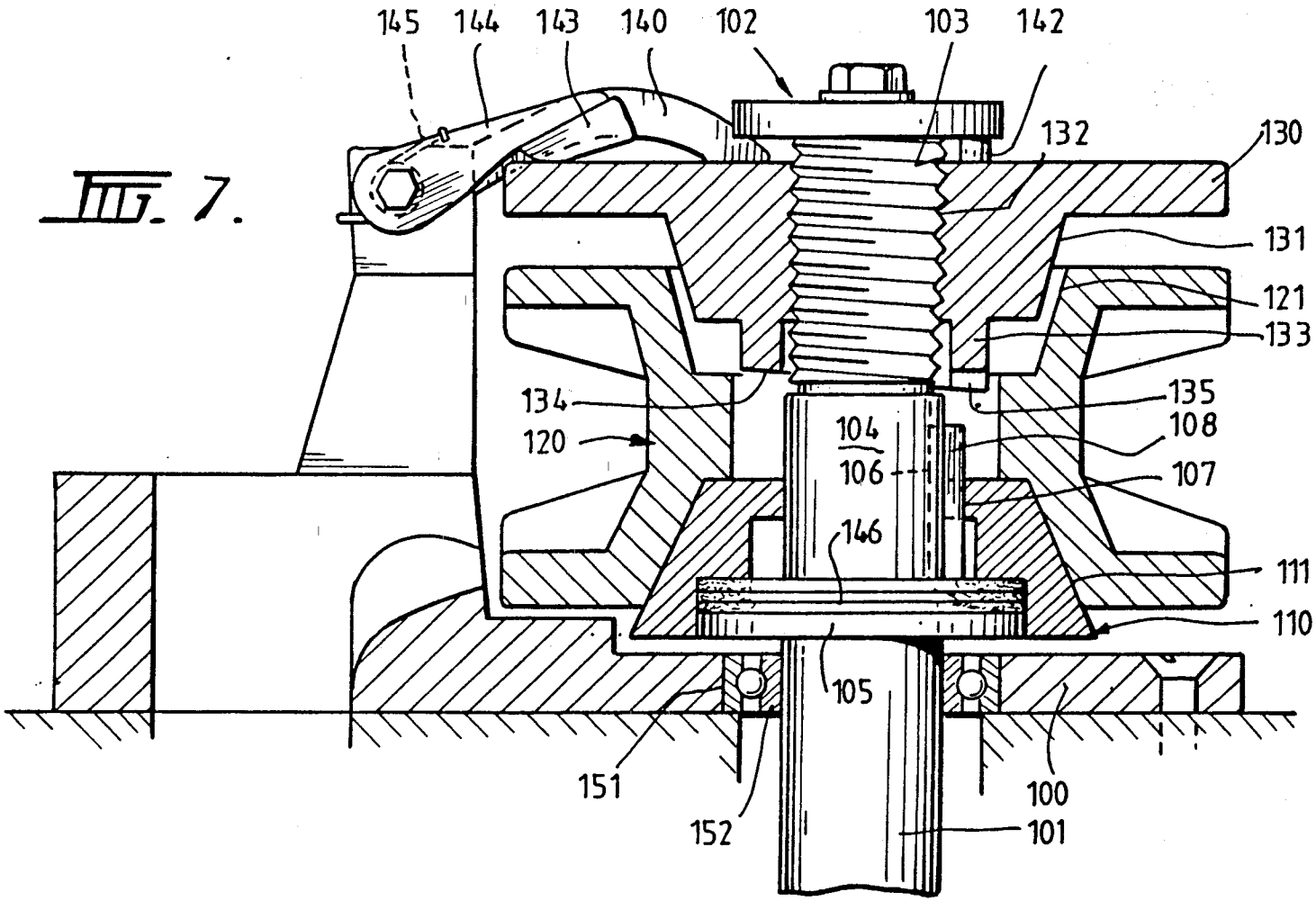
FIG. 7 is a section similar to that of FIG. 6 showing the two cones separated.

The embodiment of FIG. 6 and 7 uses the same concepts of the previous embodiment but rather than have the conical members themselves acting to receive a rope the embodiment is adapted for use with chains or with chains and ropes.

In this embodiment there is a gypsy located between two members which will still be referred to as conical members, and which have a conical portion but which could, it is to be understood, have different orientations.

Also as will be described the particular gypsy of this embodiment is a chain gypsy but it would be possible to use a composite chain/rope gypsy in which case the rope is received inwardly of the chain receiving portion and it would also be possible to have the gypsy split about an axis horizontal, with respect to the drawing, so that a good frictional engagement can be made with ropes of various diameters, within the operating parameters of the winch.

In respect of this embodiment we will not describe at any length the formation of the base 100 or the method of mounting the shaft 101 beyond referring to bearing 152 located in an aperture 151 in the base the arrangement being similar to the first embodiment.

It will be seen that, very generally, this can be similar to that of the first embodiment.

We provide a lower cone 110 located over parallel sided portion 104 of the shaft which portion 104 is provided with a keyway 106 which associates with a keyway 107 in the conical portion 111 and a key 108 which ensures that the cone 110 rotates with the shaft 101.

The cone 110 rests on rubber/neoprene spacers 146 which, together with the ring 105 provides a preset pressure on the drive assembly.

The upper portion of the shaft 103 is thrcaded, as described in the previous embodiment and the upper cone 130 has an internal thread 132 which can engage with the thread 103 of the shaft. We provide a pawl 140 which is pivotally mounted to the frame and which is adapted to enter a detent 141 in the upper surface of the cone 130.

We also provide a brake 144 which is pivotally mounted to the frame and which has a frictional engaging portion 143 and which is biased towards the second cone by means of an helical spring 145.

In this case the actual conical surfaces are shown, in respect of the first cone as 111 and the second cone 131.

Mounted between the cones there is a chain gypsy 120.

Such gypsies are known in the art and are formed to have extensions which pass between each alternate links of a chain 150 and to drive the chain by providing pressure against the link ahead of the extension.

The gypsy, in the illustrated embodiment, is effectively complementary, on its inner surfaces, to the formed inner surfaces of the cones and in particular has conical surfaces which are complementary to the equivalent surfaces on the cone.

The diameter of the gypsy corresponds effectively to a lower portion 133 of the second cone so that under operating conditions the gypsy can rotate freely relative to the cones and will be guided by the effective relationship of the conical portion 131 of the upper cone and the corresponding conical surface 121 of the gypsy.

The relationship between the gypsy and the cone can well be seen by comparison of the FIGS. 6 and 7.

FIG. 6 is the situation where a driving relationship is achieved and in this, similar to the previous embodiment there is a tapered portion 134 on the bottom of the cone which ends with a shoulder 135 which is adapted to contact the key 108 to provide positive driving interconnection between the two cones.

As in the previous embodiment the pitch of the threads 103 and 132 are such that this engagement only occurs during one revolution of the upper cone relative to the shaft and thus acts as a stop but does not otherwise restrict rotative movement of the cone.

The arrangement is also such that when the cone reaches this position the gypsy 120 is basically firmly clamped between the two cones and thus will be driven therewith.

As previously discussed in relation to the other embodiment this is the normal driving position and is stable once it is reached.

The arrangement shown in FIG. 7 shows the gypsy 120 free to rotate relative to the cones as there is no interengagement between the gypsy and the cones and this can permit the free fall position to be provided.

To reach this position the situation is effectively identical to that as described in relation to the first embodiment.

The shaft 101 is caused to rotate in the direction opposite to the driving direction, the nose of the pawl 140 locks into the detent which causes the shaft 101 to rotate relative to the cone and thus causes the cone to effectively rise up the shaft until the upper surface reacts against the stop 103. This is the position shown in FIG. 7.

When it is desired again to drive the gypsy, the shaft is rotated in the opposite direction and the brake 143 acts to prevent the cone 130 rotating with the shaft and as such the cone tends to move down the shaft until there is again engagement between the extension 135 and the key 107. At this stage the gypsy is clamped and further rotation will effect the movement of the chain or rope through the gypsy.

Figure 8:
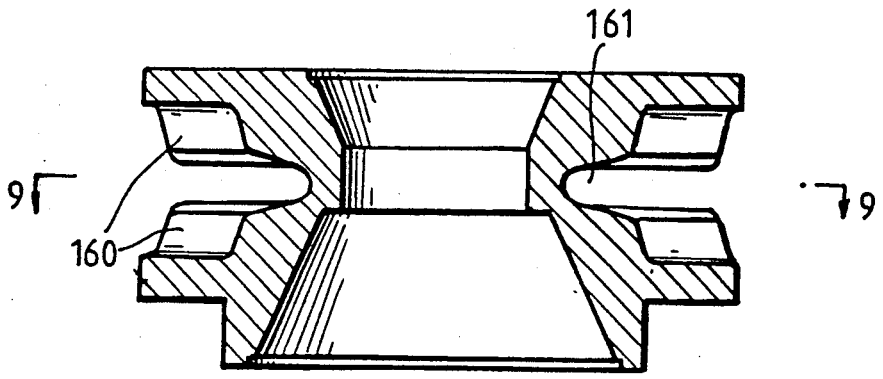
FIGS. 8 and 9 show a form of rope/chain gypsy used with the embodiment of FIGS. 6 and 7.
Figure 9:
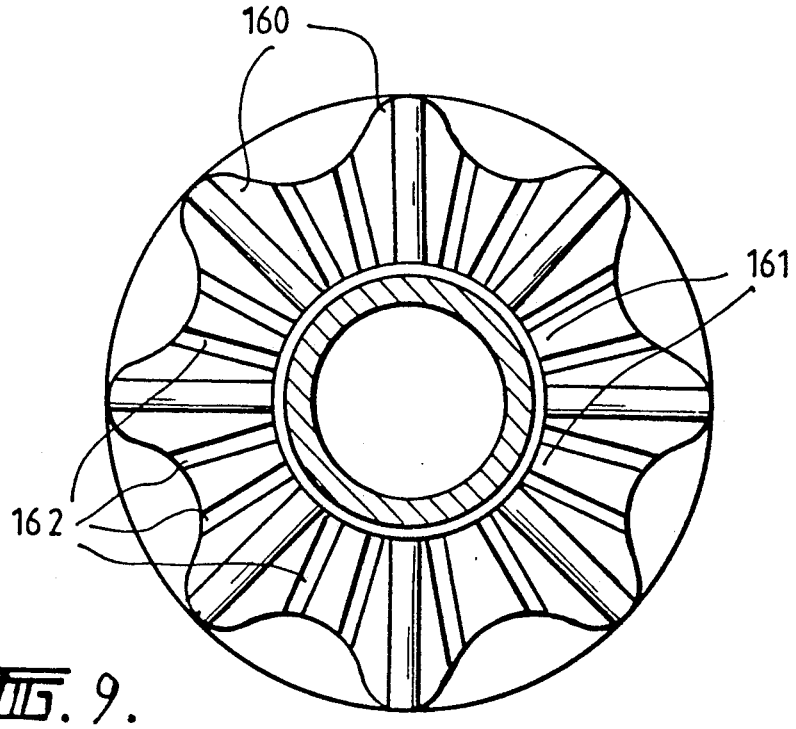

FIGS. 8 and 9 are, respectively, an axial section of a combined rope/chain gypsy and a section normal to the axis of the gypsy. The extensions 160, which are received between each of the links of a chain, terminate before an inner portion 161, which is tapered and into which a rope can pass when the gypsy is being used with a rope. The inner surfaces are formed with cut out slots 162 which act in the manner of slots 30 of the first embodiment.

In both embodiments it will be seen that the second cone is retained in its two extreme positions without necessity to provide any form of automatic locking or unlocking and at the same time can be driven from either of the positions to the other positions without the likelihood of locking up as the general arrangement is very simple and in each case has a relatively small surface of contact so there cannot be friction or binding.

I claim:

1. A self-tailing winch which can permit free-fall, comprising:

a shaft adapted to, and capable of being, driven;

a first cone connected about and fixed to said shaft to be driven therewith;

a second cone co-axial with said first cone and movable axially relative thereto along a threaded portion of said shaft, said first cone and said second cone each have a truncated conical surface, the apexes of which are inwardly directed;

means for causing said second cone to assume either of two stable axial positions relative to said first cone so that when said second cone is in a first position of said two stable axial positions, a rope or chain passing between said first cone and said second cone will be gripped firmly when rotation of said shaft in one direction occurs, rotation of said shaft in an opposite direction resulting in said second cone being held against rotation so that said first cone and said second cone move axially apart to a second position thereby permitting said rope or chain to free-fall; and, a pawl mounted adjacent said second cone, wherein said pawl enters a detent in said second cone for preventing rotation of said second cone in one direction.

2. The winch as claimed in claim 1, wherein a rope is located between said truncated conical surfaces, said truncated conical surfaces in said second position being spaced adjacent said shaft for enabling a rope to freely move and, in the first position, being spaced so as to frictionally engage with the rope for enabling it to be moved upon operation of said winch.

3. The winch as claimed in claim 2, wherein said truncated conical surfaces are formed to provide positive engagement with the rope.

4. The winch as claimed in claim 1, further comprising a braking member which comes into contact with said second cone when it is near an upper end of its movement, and stop means for preventing further movement when the second position is reached.

5. The winch as claimed in claim 1, further comprising stop means for preventing further movement when said second cone reaches its first position.

6. The winch as claimed in claim 5, wherein said stop means includes an extension on a lower edge of said second cone which contacts a member fixed relative to said first cone for preventing relative rotation between said first cone and said second cone.

7. The winch as claimed in claim 1, further comprising:

a gypsy having an upper surface and a lower surface, said upper and lower surfaces being complementary to said truncated conical surfaces so that when said first cone and said second cone are in said second position, in said first position there is frictional engagement between said truncated conical surfaces and said gypsy so that said gypsy is able to be driven by said shaft; and, a holding device for a chain or a rope of a size sufficient for grasping the chain or the rope located between said first cone and said second cone, said gypsy being rotatable relative to said truncated conical surfaces and said shaft for allowing the chain or the rope to free fall.

* * * * *